US007635290B2

(12) United States Patent
Muldowney

(10) Patent No.: US 7,635,290 B2
(45) Date of Patent: Dec. 22, 2009

(54) INTERPENETRATING NETWORK FOR CHEMICAL MECHANICAL POLISHING

(75) Inventor: Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/839,376

(22) Filed: Aug. 15, 2007

(65) Prior Publication Data

US 2009/0047871 A1 Feb. 19, 2009

(51) Int. Cl.
*B24B 49/00* (2006.01)

(52) U.S. Cl. ..... 451/7; 451/41; 451/56; 451/527

(58) Field of Classification Search ..... 451/527, 451/532, 534, 536, 7, 41, 56
See application file for complete search history.

(56) References Cited

U.S. PATENT DOCUMENTS

| | | | | |
|---|---|---|---|---|
| 4,931,287 | A | 6/1990 | Bae et al. | |
| 5,976,000 | A | 11/1999 | Hudson | |
| 6,069,080 | A * | 5/2000 | James et al. | 438/691 |
| 6,099,394 | A * | 8/2000 | James et al. | 451/72 |
| 6,296,717 | B1 | 10/2001 | Ticknor et al. | |
| 6,533,645 | B2 * | 3/2003 | Tolles | 451/41 |
| 6,857,941 | B2 | 2/2005 | Emami et al. | |
| 6,899,611 | B2 | 5/2005 | Reinhardt et al. | |
| 6,992,123 | B2 | 1/2006 | Shiho et al. | |
| 7,037,184 | B2 * | 5/2006 | Petroski et al. | 451/532 |
| 7,112,125 | B2 | 9/2006 | Hirabayashi et al. | |
| 7,160,178 | B2 | 1/2007 | Gagliardi et al. | |
| 7,374,474 | B2 * | 5/2008 | Nishiyama et al. | 451/41 |
| 2004/0226620 | A1 | 11/2004 | Therriault et al. | |
| 2004/0259479 | A1 | 12/2004 | Sevilla | |
| 2006/0052040 | A1 | 3/2006 | Prasad | |
| 2007/0190909 | A1 * | 8/2007 | Muldowney | 451/41 |
| 2007/0190916 | A1 * | 8/2007 | Muldowney | 451/527 |
| 2007/0238297 | A1 | 10/2007 | Chandrasekaran et al. | |

FOREIGN PATENT DOCUMENTS

| | | | |
|---|---|---|---|
| WO | WO 2007011158 | A1 | 1/2007 |

OTHER PUBLICATIONS

U.S. Appl. No. 11/893,495, Muldowney.

U.S. Appl. No. 11/893,785, Jiang et al.

U.S. Appl. No. 11/839,874, Jiang et al.

Tan, et al., Layer-by-layer microfluidics for biomimetic three-dimensional structures, Biomaterials 25 (2004) 1355-1364.

Tol, et al., Phase morphology and stability of co-continuous (PPE/PS)/PA6 and PS/PA6 blends: effect of rheology and reactive compatibilization, Polymer 45 (2004) 2587-2601.

(Continued)

*Primary Examiner*—Maurina Rachuba
(74) *Attorney, Agent, or Firm*—Thoams S. Deibert

(57) ABSTRACT

Chemical mechanical polishing pads are provided, wherein the chemical mechanical polishing pads have a polishing layer comprising an interpenetrating network including a continuous non-fugitive phase and a substantially co-continuous fugitive phase. Also provided are methods of making the chemical mechanical polishing pads and for using them to polish substrates.

7 Claims, 11 Drawing Sheets

OTHER PUBLICATIONS

Galloway, et al., Effect of sample size on solvent extraction for detecting cocontinuity in polymer blends, Polymer 45 (2004) 423-428.

Steigarwald, et al., Chemical Mechanical Planarization of Microelectronic Materials, John Wiley & Sons, Inc., New York, NY, pp. 66-83 (1997).

* cited by examiner

INTERPENETRATING NETWORK FOR CHEMICAL MECHANICAL POLISHING

The present invention relates generally to the field of polishing pads for chemical mechanical polishing. In particular, the present invention is directed to a chemical mechanical polishing pad having a polishing structure useful for chemical mechanical polishing magnetic, optical and semiconductor substrates.

In the fabrication of integrated circuits and other electronic devices, multiple layers of conducting, semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize or polish workpieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. Simultaneously, a slurry or other polishing medium is dispensed onto the polishing pad and is drawn into the gap between the wafer and polishing layer. To effect polishing, the polishing pad and wafer typically rotate relative to one another. As the polishing pad rotates beneath the wafer, the wafer sweeps out a typically annular polishing track, or polishing region, wherein the wafer's surface directly confronts the polishing layer. The wafer surface is polished and made planar by chemical and mechanical action of the polishing layer and polishing medium on the surface.

The interaction among polishing layers, polishing media and wafer surfaces during CMP has been the subject of increasing study, analysis, and advanced numerical modeling in the past ten years in an effort to optimize polishing pad designs. Most of the polishing pad developments since the inception of CMP as a semiconductor manufacturing process have been empirical in nature, involving trials of many different porous and non-porous polymeric materials. Much of the design of polishing surfaces, or layers, has focused on providing these layers with various microstructures, or patterns of void areas and solid areas, and macrostructures, or arrangements of surface perforations or grooves, that are claimed to increase polishing rate, improve polishing uniformity, or reduce polishing defects (scratches, pits, delaminated regions, and other surface or sub-surface damage). Over the years, quite a few different microstructures and macrostructures have been proposed to enhance CMP performance.

For conventional polishing pads, pad surface "conditioning" or "dressing" is critical to maintaining a consistent polishing surface for stable polishing performance. Over time the polishing surface of the polishing pad wears down, smoothing over the microtexture of the polishing surface-a phenomenon called "glazing". The origin of glazing is plastic flow of the polymeric material due to frictional heating and shear at the points of contact between the pad and the workpiece. Additionally, debris from the CMP process can clog the surface voids as well as the micro-channels through which slurry flows across the polishing surface. When this occurs, the polishing rate of the CMP process decreases, and this can result in non-uniform polishing between wafers or within a wafer. Conditioning creates a new texture on the polishing surface useful for maintaining the desired polishing rate and uniformity in the CMP process.

Conventional polishing pad conditioning is achieved by abrading the polishing surface mechanically with a conditioning disk. The conditioning disk has a rough conditioning surface typically comprised of imbedded diamond points. The conditioning disk is brought into contact with the polishing surface either during intermittent breaks in the CMP process when polishing is paused ("ex situ"), or while the CMP process is underway ("in situ"). Typically the conditioning disk is rotated in a position that is fixed with respect to the axis of rotation of the polishing pad, and sweeps out an annular conditioning region as the polishing pad is rotated. The conditioning process as described cuts microscopic furrows into the pad surface, both abrading and plowing the pad material and renewing the polishing texture.

Although pad designers have produced various microstructures and configurations of surface texture through both pad material preparation and surface conditioning, existing CMP pad polishing textures are less than optimal in two important aspects. First, the actual contact area between a conventional CMP pad and a typical workpiece under the applied pressures practiced in CMP is small—usually only a few percent of the total confronting area. This is a direct consequence of the inexactness of conventional surface conditioning that amounts to randomly tearing the solid regions of the structure into tatters, leaving a population of features, or asperities, of various shapes and heights of which only the tallest actually contact the workpiece. Second, the slurry flow in the thin layer at the pad surface is not optimized for the removal of debris and heat away from the workpiece. Slurry flow between the pad and workpiece must pass across the highly irregular surface and around any asperities that bridge the full vertical distance from the pad to the workpiece. This results in a high probability that the workpiece is re-exposed to both spent chemistry and material previously removed. Thus conventional pad microstructures are not optimal because contact mechanics and fluid mechanics within the surface texture are coupled: the height distribution of asperities favors neither good contact nor effective fluid flow and transport.

Defect formation in CMP has origins in both shortcomings of conventional pad microstructure. For example, Reinhardt et al., in U.S. Pat. No. 5,578,362, disclose the use of polymeric spheres to introduce texture into a polyurethane polishing pad. Although exact defect formation mechanisms are incompletely understood, it is generally clear that reducing defect formation requires minimizing extreme point stresses on the workpiece. Under a given applied load or polish pressure, the actual point contact pressure is inversely proportional to the true contact area. A CMP process running at 3 psi (20.7 kPa) polish pressure and having 2% real contact area across all asperity tips actually subjects the workpiece to normal stresses averaging 150 psi (1 MPa). Stresses of this magnitude are sufficient to cause surface and sub-surface damage. Being blunt and irregular in shape, asperities on conventional CMP pads also lead to unfavorable flow patterns: localized pressures of fluid impinging on asperities can be significant, and regions of stagnant or separated flow can lead to accumulation of polish debris and heat or create an environment for particle agglomeration.

Beyond providing potential defect formation sources, conventional polishing pad microtexture is not optimal because pad surface conditioning is typically not exactly reproducible. The diamonds on a conditioning disk become dulled with use such that the conditioner must be replaced after a period of time; during its life the effectiveness of the conditioner thus continually changes. Conditioning also contributes greatly to the wear rate of a CMP pad. It is common for about 95% of the wear of a pad to result from the abrasion of the diamond conditioner and only about 5% from contact with workpieces. Thus in addition to defect reduction, improved pad microstructure could eliminate the need for conditioning and allow longer pad life.

The key to eliminating pad conditioning is to devise a polishing surface that is self-renewing, that is, that retains the same essential geometry and configuration as it wears. Thus to be self-renewing, the polishing surface must be such that wear does not significantly reshape the solid regions. This in turn requires that the solid regions not be subjected to continuous shear and heating sufficient to cause a substantial degree of plastic flow, or that the solid regions be configured so that they respond to shear or heating in a way that distributes the shear and heating to other solid regions.

In addition to low defectivity, CMP pad polishing structures must achieve good planarization efficiency. Conventional pad materials require a trade-off between these two performance metrics because lower defectivity is achieved by making the material softer and more compliant, yet these same property changes compromise planarization efficiency. Ultimately, planarization requires a stiff flat material; while low defectivity requires a less stiff conformal material. It is thus difficult to surmount the essential trade-off between these metrics with a single material. Conventional pad structures approach this problem in a variety of ways, including the use of composite materials having hard and soft layers bonded to one another. While composites offer improvements over single-layer structures, no material has yet been developed that achieves ideal planarization efficiency and zero defect formation simultaneously.

Consequently, while pad microstructure and conditioning means exist for contemporary CMP applications, there is a need for CMP pad designs that achieve higher real contact area with the workpiece and more effective slurry flow patterns for removal of polish debris, as well as reducing or eliminating the need for re-texturing. In addition, there is a need for CMP pad structures that combine a rigid stiff structure needed for good planarization efficiency with a less stiff conformal structure needed for low defectivity. Also, there is a need for CMP pad structures that provide a high void volume in the polishing layer proximate the polishing surface to facilitate good slurry access to individual contact points with the workpiece, but which do not present a large void volume within the polishing layer distant from the polishing surface (which void volume might support the accumulation of stagnant slurry and polishing waste).

In one aspect of the present invention, there is provided a chemical mechanical polishing pad for polishing a substrate selected from at least one of a magnetic substrate, an optical substrate and a semiconductor substrate; comprising: a polishing layer comprising an interpenetrating network, wherein the interpenetrating network comprises a continuous non-fugitive phase and a substantially co-continuous fugitive phase; and wherein the polishing layer has a polishing surface adapted for polishing the substrate.

In another aspect of the present invention, there is provided a chemical mechanical polishing pad for polishing a substrate selected from at least one of a magnetic substrate, an optical substrate and a semiconductor substrate; comprising: a polishing layer comprising an interpenetrating network, wherein the interpenetrating network comprises a continuous non-fugitive phase and a substantially co-continuous fugitive phase; wherein the non-fugitive phase forms a three-dimensional network that comprises a plurality of interconnected polishing elements that define a reticulated interstitial area; wherein the substantially co-continuous fugitive phase is disposed within the reticulated interstitial area; and, wherein the polishing surface is adapted for polishing the substrate.

In another aspect of the present invention, there is provided a method for polishing a substrate, comprising: providing a substrate selected from at least one of a magnetic substrate, an optical substrate and a semiconductor substrate; providing a chemical mechanical polishing pad having a polishing layer comprising an interpenetrating network, wherein the interpenetrating network comprises a continuous non-fugitive phase and a substantially co-continuous fugitive phase, wherein the polishing layer has a polishing surface adapted for polishing the substrate; providing a polishing medium at an interface between the polishing surface and the substrate; and, creating dynamic contact at the interface between the chemical mechanical polishing pad and the substrate.

DETAILED DESCRIPTION

Figure 1:
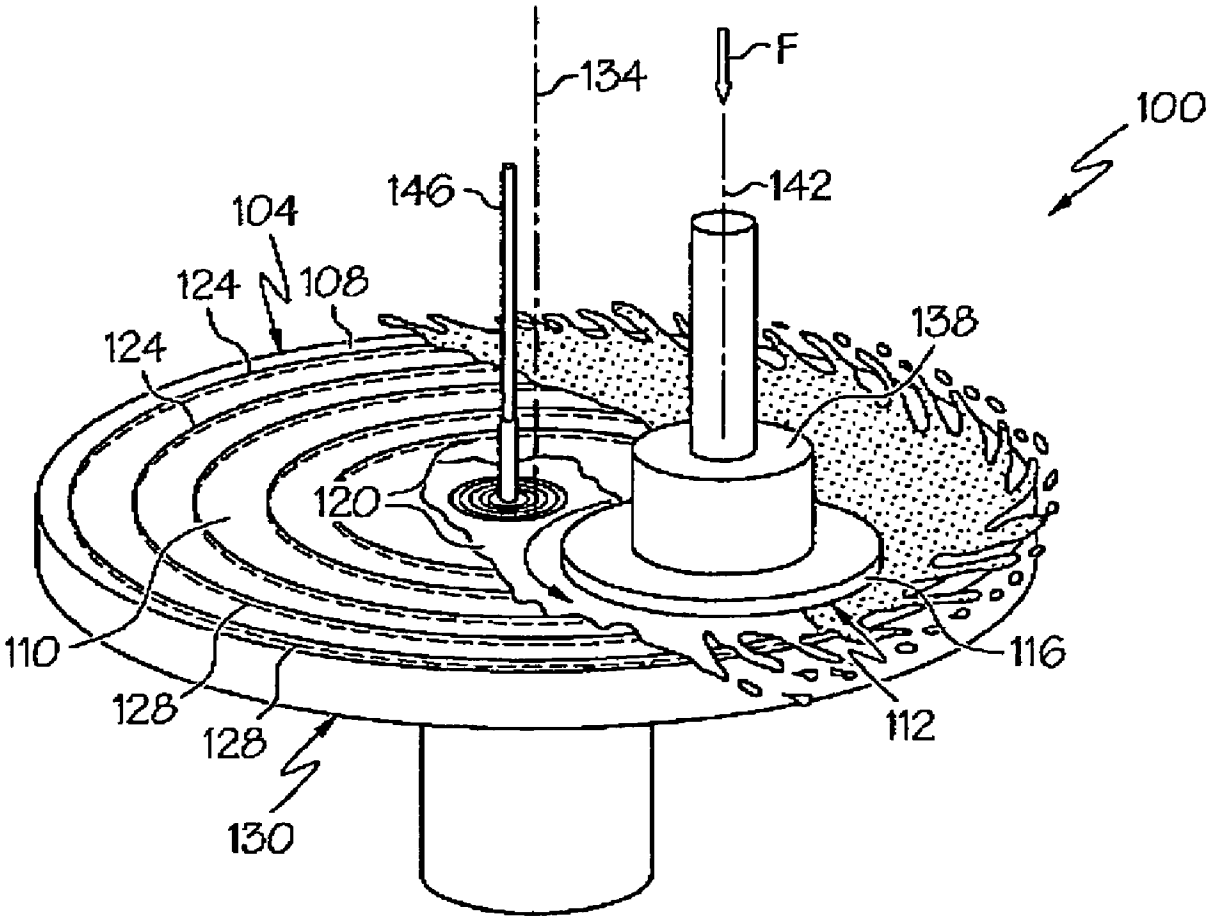
FIG. 1 is a perspective view of a portion of a dual-axis polisher suitable for use with the chemical mechanical polishing pads of the present invention.

The term "chemical bond" as used herein and in the appended claims refers to attractive forces between atoms and encompasses covalent bonds, ionic bonds, metallic bonds, hydrogen bonds and van der Waals forces.

The term "fibrillar morphology" as used herein and in the appended claims refers to a morphology of a phase in which the phase domains have a three dimensional shape with one dimension much larger than the other two dimensions.

The term "fugitive phase" as used herein and in the appended claims refers to a phase that melts, dissolves or disintegrates upon exposure to at least one of the polishing medium and heat.

The term "hydrodynamic layer" as used herein and in the appended claims refers to a region of a polishing layer proximate the polishing surface which is substantially free of the co-continuous fugitive phase.

The term "interpenetrating network" as used herein and in the appended claims refers to a network comprising a continuous non-fugitive phase and a substantially co-continuous fugitive phase, wherein the fugitive phase (a) is not covalently bound to the non-fugitive phase and (b) cannot be separated from the non-fugitive phase unless chemical bonds are broken within at least one of the phases.

The term "interpenetrating polymer network" as used herein and in the appended claims refers to a polymeric network comprising a continuous non-fugitive polymeric phase and a substantially co-continuous fugitive polymeric phase, wherein the fugitive polymeric phase (a) is not covalently bound to the non-fugitive phase and (b) cannot be separated from the non-fugitive phase unless chemical bonds are broken within at least one of the phases.

The term "macrotexture" as used herein and in the appended claims in reference to the polishing surface refers to larger size textured artifacts that may be imposed by embossing, skiving, perforating and/or machining of the polishing surface.

The term "non-water soluble" as used herein and in the appended claims encompasses materials that have a solubility in water at 25° C. of ≦0.1 mmoles/L and which do not disintegrate upon submersion in water for 48 hours.

The term "polishing medium" as used herein and in the appended claims encompasses particle-containing polishing solutions and non-particle-containing solutions, such as abrasive-free and reactive-liquid polishing solutions.

The term "substantially free" as used herein and in the appended claims means less than 5 vol %.

The term "substantially circular" as used herein and in the appended claims in reference to the polishing elements means that the radius, r, of the cross section varies by ≦20% for the cross section.

The term "substantially circular cross section" as used herein and in the appended claims in reference to the polishing surface means that the radius, r, of the cross section from the central axis to the outer periphery of the polishing surface varies by ≦20% for the cross section. (See FIG. 6).

The term "substantially co-continuous" as used herein and in the appended claims refers to an interpenetrating network in which the fugitive phase is at least 80 wt % continuous.

The term "water soluble" as used herein and in the appended claims encompasses materials that dissolve, dissociate or disintegrate upon exposure to water.

In some embodiments of the present invention, the chemical mechanical polishing pad comprises: a polishing layer comprising an interpenetrating network, wherein the interpenetrating network comprises a continuous non-fugitive phase and a substantially co-continuous fugitive phase; and wherein the polishing layer has a polishing surface adapted for polishing the substrate. In some aspects of these embodiments, the fugitive phase does not contain abrasive grains (e.g., cerium oxide, manganese oxide, silica, alumina, zirconia). In some aspects of these embodiments, the fugitive phase does not contain a pharmaceutical active. In some aspects of these embodiments, the fugitive phase does not contain an agricultural active (e.g., a fertilizer, insecticide, herbicide). In some aspects of these embodiments, the interpenetrating network is an interpenetrating polymer network.

In some embodiments of the present invention, the chemical mechanical polishing pad comprises: a polishing layer comprising an interpenetrating network, wherein the interpenetrating network comprises a continuous non-fugitive phase and a substantially co-continuous fugitive phase; and wherein the polishing layer has a polishing surface adapted for polishing the substrate. In some aspects of these embodiments, the degree of continuousness of the fugitive phase is determined by solvent extraction methodology. For example, a sample of the polishing layer is submerged in a volume of water sufficiently large to dissolve 100% of the fugitive phase material with a saturation of <80%. The sample is left submerged in the water for 14 days. The sample is then removed from the water and dried. The weight of the sample subsequent to submersion is compared with its weight prior to submersion. A 90% continuous phase would lose 90 wt % of its fugitive phase as a result of the 14 day submersion. In some aspects of these embodiments, the fugitive phase is at least 80 wt % continuous. In some aspects of these embodiments, the fugitive phase is 90 to 100 wt % continuous. In some aspects of these embodiments, the fugitive phase is 95 to 100 wt % continuous. In some aspects of these embodiments, the fugitive phase is 99 to 100 wt % continuous.

Selection of materials for use in the continuous non-fugitive phase is limited by the suitability of those materials for use in a given polishing operation for a substrate made of a particular substance or combination of substances.

In some embodiments of the present invention, the continuous non-fugitive phase comprises at least one of a polymeric material and a non-polymeric material. In some aspects of these embodiments, the continuous non-fugitive phase comprises a composite of a polymeric material and a non-polymeric material.

In some embodiments of the present invention, the continuous non-fugitive phase comprises a polymeric material. In some aspects of these embodiments, the polymeric material comprises a polymer selected from polycarbonates, polysulfones, nylons, polyethers, polyesters, polystyrenes, acrylic polymers, polymethyl methacrylates, polyvinylchlorides, polyvinylfluorides, polyethylenes, polypropylenes, polybutadienes, polyethylene imines, polyurethanes, polyether sulfones, polyamides, polyether imides, polyketones, epoxies, silicones and combinations thereof.

In some embodiments of the present invention, the continuous non-fugitive phase comprises a non-polymeric material. In some aspects of these embodiments, the non-polymeric material comprises a substance selected from ceramic, glass, metal, stone, wood, or a solid phase of a simple material (e.g., ice).

In some embodiments of the present invention, the formulation of the fugitive phase is selected such that the fugitive phase proximate the polishing surface melts, dissolves or disintegrates upon exposure to at least one of the polishing medium and specific polishing conditions (e.g., an elevated temperature above melting point of at least a portion of the fugitive phase). In some aspects of these embodiments, the fugitive phase proximate the polishing surface melts, dissolves or disintegrates upon exposure to the polishing medium and/or specific polishing conditions at a rate comparable to the rate at which the non-fugitive phase is worn away during polishing. In some aspects of these embodiments, the fugitive phase formulation is selected such that the heat and dynamic forces generated during polishing in the area of the pad proximate the polishing surface are sufficient to facilitate the melting, dissolution or disintegration of the fugitive phase proximate the polishing surface. In some aspects of these embodiments, the fugitive phase formulation is selected such that contact with a polishing medium (e.g., a slurry) causes the fugitive phase to dissolve or disintegrate over time at a uniform (time release) rate. One of ordinary skill in the art will know how to select the fugitive phase formulation to provide the desired rate of melting, dissolution or disintegration for a given polishing operation.

In some embodiments, the fugitive phase melts upon exposure to elevated temperatures present during polishing.

In some embodiments, the fugitive phase dissolves or disintegrates upon exposure to a polishing medium (e.g., an aqueous slurry). In some aspects of these embodiments, the dissolution or disintegration of the fugitive phase is dependent on the pH of the polishing medium. That is, the fugitive phase only dissolves or disintegrates when exposed to a polishing medium with a pH of ≦6 or ≧8 (i.e., a non-neutral pH).

In some embodiments of the present invention, the fugitive phase comprises a hydrolizable material. In some aspects of these embodiments, the fugitive phase comprises a material that is soluble in an aqueous medium at a rate of 0.01 to 10.0 mg/min under polishing conditions in which the chemical mechanical polishing pad and the substrate are moving relative to one another at a rate of 1.0 m/sec under a nominal down force of <1 to 5 psi.

In some embodiments of the present invention, the fugitive phase comprises at least one of a water soluble material, a water disintegratable material, and a material that melts at the temperatures present during polishing proximate the polishing surface of the chemical mechanical polishing pad. In some aspects of these embodiments, the fugitive phase comprises at least one of: a polymeric material derived from the polymerization of at least one monomer selected from acrylic acid, methacrylic acid, itaconic acid, fumaric acid, maleic acid, hydroxyalkyl arcylate, hydroxyalkyl methacrylate, N-vinyl-2-pyrrolidone, methylvinyl ether, N-vinyl formamide and N,N-dimethylacryl amide; a polysaccharide (e.g., α, β and γ-cyclodextrin); a cellulosic material (e.g., hydroxypropyl cellulose, carboxymethyl cellulose, methylcellulose); a protein; a polyvinyl alcohol; a polyethylene oxide; pullulan; a sulfonated polyisoprene; calcium sulfate; sodium silicate; polyethylene glycol solids; paraffin waxes; and, agar starches.

In some embodiments of the present invention, the fugitive phase optionally includes one or more additives to facilitate the controlled rate of dissolution or disintegration of the fugitive phase. In some embodiments of the present invention, the fugitive phase optionally includes one or more surfactants or other materials to facilitate the dissolution of the fugitive phase into the polishing medium.

In some embodiments of the present invention, the chemical mechanical polishing pad comprises a hydrodynamic region proximate to the polishing surface, wherein the hydrodynamic region is substantially free of the fugitive phase. In some aspects of these embodiments, the hydrodynamic region contains ≦5 vol % fugitive phase material. In some aspects of these embodiments, the hydrodynamic region contains ≦3 vol % fugitive phase material. In some aspects of these embodiments, the hydrodynamic region contains less than ≦2 vol % fugitive phase material. In some aspects of these embodiments, the hydrodynamic region contains less than ≦1 vol % fugitive phase material.

In some embodiments of the present invention, the polishing layer has a hydrodynamic region that encompasses the polishing surface, wherein the hydrodynamic region is substantially free of the fugitive phase. In some aspects of these embodiments, the hydrodynamic region is bounded on one side by the polishing surface and has an average thickness across the polishing pad of 1 to 100 microns. In some aspects of these embodiments, the hydrodynamic region is bounded on one side by the polishing surface and has an average thickness across the polishing pad of 1 to 50 microns. In some aspects of these embodiments, the hydrodynamic region is bounded on one side by the polishing surface and has an average thickness across the polishing pad of 1 to 25 microns. Is some aspects of these embodiments, the average thickness of the hydrodynamic region remains stable during use of the polishing pad. In some aspects of these embodiments, the average thickness of the hydrodynamic region varies by <20% over multiple polishing operations (e.g., after polishing 10 wafers). In some aspects of these embodiments, the average thickness of the hydrodynamic region varies by <10% over multiple polishing operations. In some aspects of these embodiments, the average thickness of the hydrodynamic region varies by <5% over multiple polishing operations.

If the average thickness of the hydrodynamic region varies significantly over time during polishing (i.e., ≧20%), the volume of polishing medium held in the polishing pad may change and the micro flow patterns in the hydrodynamic region may also change. For example, if the average thickness of the hydrodynamic layer shrinks, the volume of polishing medium held in the polishing pad may decrease and the micro flow patterns of the polishing medium in the hydrodynamic region may change over time from polishing operation to polishing operation. Alternatively, if the average thickness of the hydrodynamic region expands over time, the volume of polishing medium held in the chemical mechanical polishing pad may increase, the micro flow patterns of the slurry in the hydrodynamic layer may change, and the volume of essentially stagnant polishing medium held in the chemical mechanical polishing pad will increase over time from polishing operation to polishing operation. Stagnant polishing medium held in the chemical mechanical polishing pad may result in the undesirable accumulation of solid material debris, which solid material may include abrasive from the polishing medium and various waste products from the polishing process. The accumulation of such solid material debris in the chemical mechanical polishing pad may hinder the free flow of slurry within the interstitial openings in the polishing layer. Given the teachings provided in this application, one of ordinary skill in the art will recognize that a chemical mechanical polishing pad of the present invention with a fugitive phase formulation that melts, dissolves, or disintegrates too quickly or too slowly relative to the rate at which the non-fugitive phase wears away, may exhibit non-uniform performance from polishing operation to polishing operation (e.g., from wafer to wafer) over the life of the polishing pad. Accordingly, given the teachings of this application, one of ordinary skill in the art will recognize that a chemical mechanical polishing pad of the present invention with a fugitive phase formulation that melts, dissolves or disintegrates too quickly or too slowly will not be optimized from polishing operation to polishing operation (e.g., from wafer to wafer) over the life of the polishing pad.

In some embodiments of the present invention, the co-continuous fugitive phase is water soluble.

In some embodiments of the present invention, the continuous non-fugitive phase is non-water soluble and the co-continuous fugitive phase is water soluble.

In some embodiments of the present invention, the co-continuous fugitive phase melts upon exposure to heat generated during polishing.

In some embodiments of the present invention, the continuous non-fugitive phase forms a reticulated network. In some aspects of these embodiments, at least a portion of the interstitial void volume within the reticulated network formed by the continuous non-fugitive phase is occupied by the co-continuous fugitive phase. In some aspects of these embodiments, at least 50 vol % of the interstitial void volume within the reticulated network is occupied by the co-continuous fugitive phase. In some aspects of these embodiments, at least 75 vol % of the interstitial void volume within the reticulated network is occupied by the co-continuous fugitive phase. In some aspects of these embodiments, at least 90 vol % of the interstitial void volume within the reticulated network is occupied by the co-continuous fugitive phase. In some aspects of these embodiments, 50 vol % to 100 vol % of the interstitial void volume within the reticulated network is occupied by the co-continuous fugitive phase. In some aspects of these embodiments, 50 to 99 vol % of the interstitial void volume within the reticulated network is occupied by the co-continuous fugitive phase. In some aspects of these embodiments, 75 to 99 vol % of the interstitial void volume within the reticulated network is occupied by the co-continuous fugitive phase. In some aspects of these embodiments, the continuous non-fugitive phase has a fibrillar morphology. In some aspects of these embodiments, the continuous non-fugitive phase has a double gyroid morphology. In some aspects of these embodiments, the continuous non-fugitive phase forms an interconnected network of structural members.

In some embodiments of the present invention, the continuous non-fugitive phase has a fibrillar morphology composed of a multiplicity of polishing elements, wherein a cross-sectional area of each polishing element along a long dimension thereof varies by ≦30% across the long dimension. In some aspects of these embodiments, the cross-sectional area varies by ≦25%; preferably ≦20%; more preferably ≦10% across the long dimension. In some aspects of these embodiments, the cross-sectional area of each polishing element along a long dimension thereof is substantially circular. In some aspects of these embodiments, the cross-sectional area of each polishing element along a long dimension thereof is streamlined with respect to fluid flow in a plane of the cross-sectional area.

In some embodiments of the present invention, the polishing layer comprises 0.5 to 80 vol % continuous non-fugitive phase material. In some aspects of these embodiments, the polishing layer comprises ≧1 vol % to ≦50 vol % continuous non-fugitive phase material.

In some embodiments of the present invention, the polishing layer has an average thickness of 20 to 150 mils. In some aspects of these embodiments, the polishing layer has an average thickness of 30 to 125 mils. In some aspects of these embodiments, the polishing layer has an average thickness of 40 to 120 mils.

In some embodiments of the present invention, the chemical mechanical polishing pad has a polishing surface with a surface area measured in a plane parallel to the polishing surface that changes by ≦10% over multiple polishing operations (i.e., after polishing 10 wafers). In some aspects of these embodiments, the polishing area changes by ≦5%; more preferably ≦2%; still more preferably ≦1%.

In some embodiments of the present invention, the chemical mechanical polishing pad comprises a polishing layer interfaced with a base layer. In some aspects of these embodiments, the polishing layer is attached to the base layer using an adhesive. In some aspects of these embodiments, the adhesive is selected from pressure sensitive adhesives, hot melt adhesives, contact adhesives and combinations thereof. In some aspects of these embodiments, the adhesive is a hot melt adhesive. In some aspects of these embodiments, the adhesive is a contact adhesive. In some aspects of these embodiments, the adhesive is a pressure sensitive adhesive.

In some embodiments of the present invention, the chemical mechanical polishing pad comprises a polishing layer, a base layer and at least one additional layer interposed between the base layer and the polishing layer.

In some embodiments of the present invention, the chemical mechanical polishing pad has a polishing surface that optionally exhibits macrotexture to facilitate polishing the substrate. In some aspects of these embodiments, the macrotexture is designed to alleviate at least one of hydroplaning; to influence polishing medium flow; to modify the stiffness of the polishing layer; to reduce edge effects; and, to facilitate the transfer of polishing debris away from the area between the polishing surface and the substrate. In some aspects of these embodiments, the polishing surface exhibits macrotexture selected from at least one of perforations and grooves. In some aspects of these embodiments, the perforations can extend from the polishing surface part way or all of the way through the thickness of the polishing layer. In some aspects of these embodiments, the grooves are arranged on the polishing surface such that upon rotation of the pad during polishing, at least one groove sweeps over the substrate. In some aspects of these embodiments, the grooves are selected from curved grooves, linear grooves and combinations thereof.

In some embodiments of the present invention, the polishing layer optionally exhibits a macrotexture comprising a groove pattern. In some aspects of these embodiments, the groove pattern comprises at least one groove. In some aspects of these embodiments, the groove pattern comprises a plurality of grooves. In some aspects of these embodiments, the at least one groove is selected from curved grooves, straight grooves and combinations thereof. In some aspects of these embodiments, the groove pattern is selected from a groove design including, for example, concentric grooves, curved grooves, cross-hatch grooves (e.g., arranged as an X-Y grid across the pad surface), other regular designs (e.g., hexagons, triangles), tire-tread type patterns, irregular designs (e.g., fractal patterns), and combinations thereof. In some aspects of these embodiments, the groove pattern is selected from random, concentric, spiral, cross-hatched, X-Y grid, hexagonal, triangular, fractal and combinations thereof. In some aspects of these embodiments, the groove profile is selected from rectangular with straight side-walls or the groove cross-section may be "V"-shaped, "U"-shaped, triangular, rhomboid, saw-tooth, and combinations thereof. In some aspects of these embodiments, the groove pattern is a groove design that changes across the polishing surface. In some aspects of these embodiments, the groove design is engineered for a specific application. In some aspects of these embodiments, the groove dimensions in a specific design may be varied across the pad surface to produce regions of different groove densities.

In some embodiments of the present invention, the chemical mechanical polishing pad is adapted to be interfaced with a platen of a polishing machine. In some aspects of these embodiments, the chemical mechanical polishing pad is adapted to be affixed to the platen. In some aspects of these embodiments, the chemical mechanical polishing pad is adapted to be affixed to the platen using at least one of a pressure sensitive adhesive and vacuum.

In some embodiments of the present invention, the method for polishing a substrate comprises: providing a substrate selected from at least one of a magnetic substrate, an optical substrate and a semiconductor substrate; providing a chemical mechanical polishing pad having a polishing layer comprising an interpenetrating network, wherein the interpenetrating network comprises a continuous non-fugitive phase and a substantially co-continuous fugitive phase, wherein the polishing layer has a polishing surface adapted for polishing the substrate; providing a polishing medium at an interface between the polishing surface and the substrate; and, creating dynamic contact at the interface between the chemical mechanical polishing pad and the substrate. In some aspects of these embodiments, the method further comprises interfacing the polishing pad with a platen of a polishing machine. In some aspects of these embodiments, the method further comprises conditioning the polishing surface. In some aspects of these embodiments, the co-continuous fugitive phase is 100 wt % continuous. In some aspects of these embodiments, the co-continuous fugitive phase is 80 to 100 wt % continuous. In some aspects of these embodiments, the co-continuous fugitive phase is 90 to 100 wt % continuous. In some aspects of these embodiments, the co-continuous fugitive phase is 95 to 100 wt % continuous. In some aspects of these embodiments, the co-continuous fugitive phase is 99 to 100 wt % continuous. In some aspects of these embodiments, the substrate comprises a series of patterned semiconductor wafers.

Referring to the drawings, FIG. 1 generally illustrates the primary features of a dual-axis chemical mechanical polishing (CMP) polisher 100 suitable for use with a polishing pad 104 of the present invention. Polishing pad 104 generally includes a polishing layer 108 having a polishing surface 110 for confronting an article, such as semiconductor wafer 112 (processed or unprocessed) or other workpiece, e.g., glass, flat panel display or magnetic information storage disk, among others, so as to effect polishing of the polished surface 116 of the workpiece in the presence of a polishing medium 120. Polishing medium 120 travels through optional spiral grooves 124 having a depth 128.

The present invention generally includes providing polishing layer 108 with a polishing texture 200 (FIG. 2) having a high void fraction or percentage of open volume versus solid volume in a hydrodynamic region 203 thereof, by forming polishing layer 108 from a continuous non-fugitive phase material 207 comprised of a series of similar or identical macroscopic or microscopic slender elements, each element constrained at one or more ends, such that the total space occupied by these elements is small relative to the total space available, the spacing of individual elements is small relative to the size of the wafer, and the elements are interconnected in three dimensions to stiffen the network with respect to shear and bending. Preferably, the elements have microscopic dimensions to create a microtexture. These features will be shown to provide both higher real contact area between the pad and wafer and more favorable slurry flow patterns in the hydrodynamic region 203, which is not occupied by a co-continuous fugitive phase material 205, between the pad and wafer than are realized using conventional polishing pads, as well as providing a self-renewing structure that reduces or eliminates the need for pad conditioning. In addition, these features will be shown to function in a way that imparts stiffness to the pad at the length scale required for good planarization efficiency while allowing compliance at the shorter length scales required for low defectivity.

Polisher 100 may include polishing pad 104 mounted on platen 130. Platen 130 is rotatable about a rotational axis 134 by a platen driver (not shown). Wafer 112 may be supported by a wafer carrier 138 that is rotatable about a rotational axis 142 parallel to, and spaced from, rotational axis 134 of platen 130. Wafer carrier 138 may feature a gimbaled linkage (not shown) that allows wafer 112 to assume an aspect very slightly non-parallel to polishing layer 108, in which case rotational axes 134, 142 may be very slightly askew. Wafer 112 includes polished surface 116 that faces polishing layer 108 and is planarized during polishing. Wafer carrier 138 may be supported by a carrier support assembly (not shown) adapted to rotate wafer 112 and provide a downward pressure F to press polished surface 116 against polishing layer 108 so that a desired pressure exists between the polished surface and the polishing layer during polishing. Polisher 100 may also include a polishing medium dispenser 146 for supplying polishing medium 120 to polishing layer 108.

As those ordinarily skilled in the art will appreciate, polisher 100 may include other components (not shown) such as a system controller, polishing medium storage and dispensing system, heating system, rinsing system and various controls for controlling various aspects of the polishing process, such as follows: (1) speed controllers and selectors for one or both of the rotational rates of wafer 112 and polishing pad 104; (2) controllers and selectors for varying the rate and location of delivery of polishing medium 120 to the pad; (3) controllers and selectors for controlling the pressure F applied between the wafer and polishing pad, and (4) controllers, actuators and selectors for controlling the location of rotational axis 142 of the wafer relative to rotational axis 134 of the pad, among others. Those skilled in the art will understand how these components are constructed and implemented such that a detailed explanation of them is not necessary for those skilled in the art to understand and practice the present invention.

During polishing, polishing pad 104 and wafer 112 are rotated about their respective rotational axes 134, 142 and polishing medium 120 is dispensed from polishing medium dispenser 146 onto the rotating polishing pad. Polishing medium 120 spreads out over polishing layer 108, including the gap beneath wafer 112 and polishing pad 104. Polishing pad 104 and wafer 112 are typically, but not necessarily, rotated at selected speeds of 0.1 rpm to 150 rpm. Pressure F is typically, but not necessarily, selected from a pressure of 0.1 psi to 15 psi (6.9 to 103 kPa) between wafer 112 and polishing pad 104. As those of ordinary skill in the art will recognize, it is possible to configure the polishing pad in a web format or into polishing pads having a diameter less than the diameter of the substrate being polished.

Figure 2:
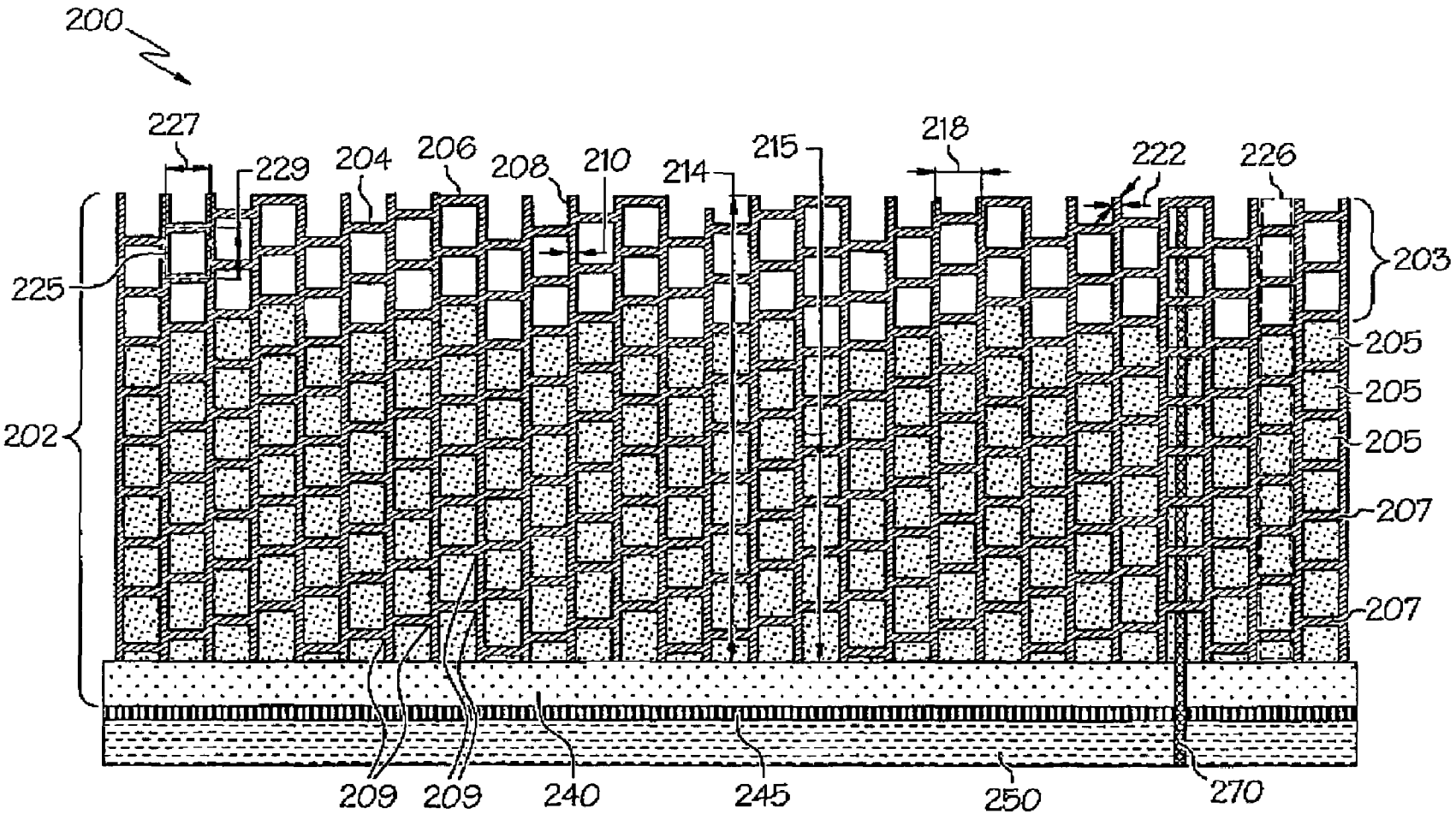
FIG. 2 is a highly enlarged, partial, schematic, cross-sectional, elevational view of a chemical mechanical polishing pad of one embodiment of the present invention.
Figure 3:
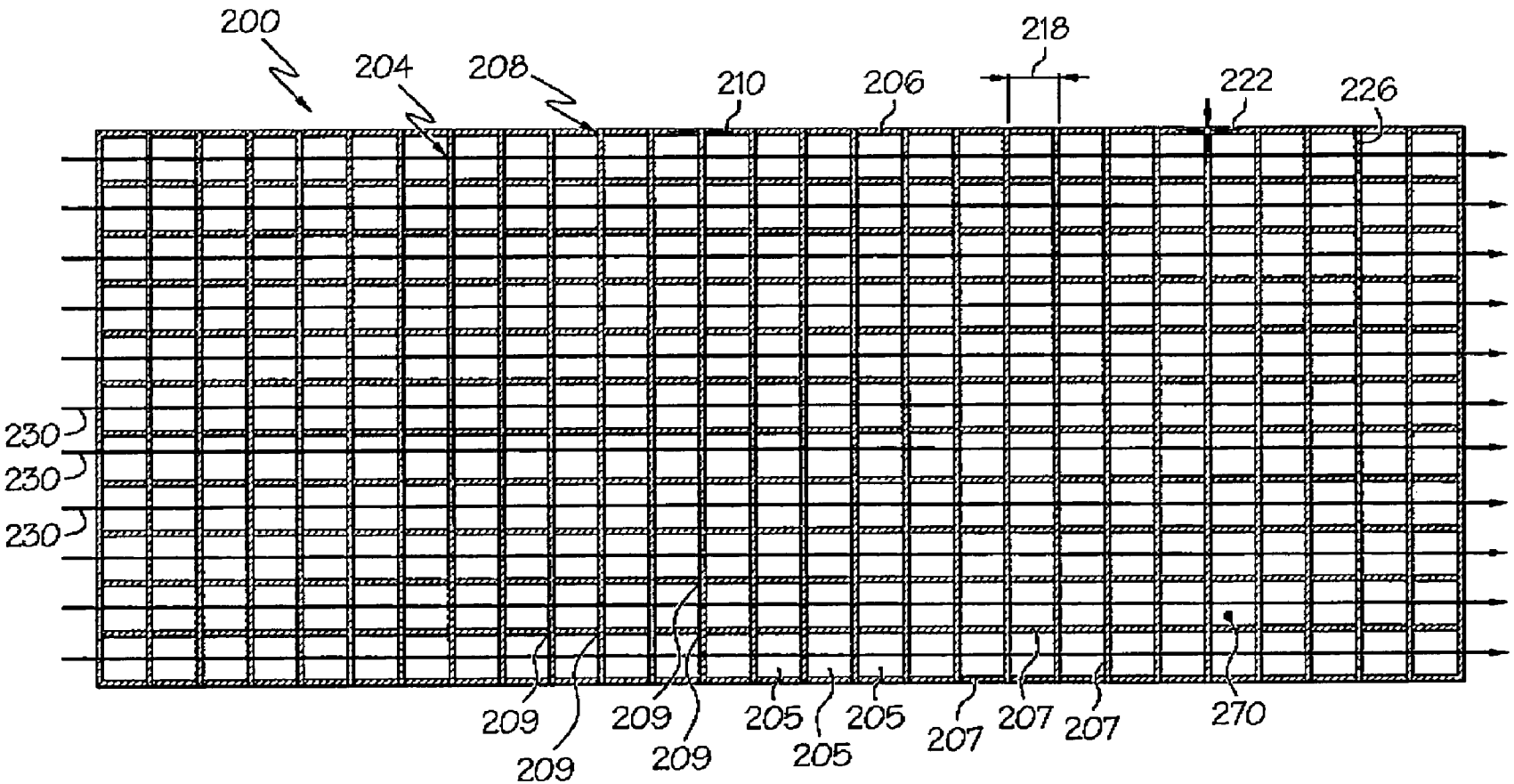
FIG. 3 is a highly enlarged, partial, schematic, plan view of the polishing pad of FIG. 2.

Referring now to FIGS. 2 and 3, embodiments of polishing pad 104 of FIG. 1 will be described in more detail, in particular relative to surface polishing texture 200. In contrast to conventional CMP pads in which surface texture or asperities are the residue of a material removal or reshaping process (i.e. conditioning), polishing texture 200 is built as a series of identical or similar polishing elements 204 and 208 having a precise geometry. For purposes of illustration, polishing texture 200 is shown to consist of substantially vertical elements 208 and substantially horizontal elements 204, but this need not be the case. Polishing texture 200 is tantamount to a multitude of such polishing elements 204 and 208 each having a mean width 210 and a mean cross-sectional area 222, the elements being spaced at a mean pitch 218. As used here and throughout, the term "mean" designates the arithmetic average taken over the entire volume of the element or structure. In addition, the interconnected network of elements 204, 208 has a mean height 214 and mean half-height 215. The polishing texture 200 is in effect a set of hexahedral unit cells, that is spatial units in which each face (of six) is a square or rectangle and solid members run along the edges only of the spatial unit, leaving the center of each face and of the spatial unit as a whole empty.

The mean height 214 to mean width 210 ratio of elements 208 is at least 0.5. Preferably the mean height 214 to mean width 210 ratio is at least 0.75 and most preferably at least 1. Optionally, the mean height 214 to mean width 210 ratio may be at least 5 or at least 10. As the mean height increases, the number of interconnecting elements 204 required to stiffen the network of polishing elements 208 during polishing increases. In general, only the unconstrained ends of elements 208 projecting beyond the uppermost interconnecting elements 204 are free to flex under shear forces during polishing. The heights of elements 208 between the base layer 240 and the uppermost interconnecting element 204 are highly constrained and forces applied to any one element 208 are effectively carried by many adjacent elements 204 and 208, similar to a bridge truss or external buttressing. In this way polishing texture 200 is rigid at the length scale required for good planarization, but is locally compliant at shorter length scales by virtue of the local deformability and flexibility of the unbuttressed ends of elements 208.

The interconnecting elements 204 and polishing elements 208 combine to form a unit cell 225, the unit cell having a mean width 227 and a mean length 229. These unit cells have a reticulated or open-cell structure that combine to form the three-dimensional network. In some embodiments of the present invention, the interconnect unit cells have a height of at least three unit cells and preferably at least 10 unit cells. Generally, increasing the height of the polishing pad increases the life of the polishing pad as well as its bulk stiffness, the latter contributing to improved planarization. Optionally, the unit cell's mean width 227 does not equal its mean length 229. For example a mean width to mean length ratio may be of at least 2 or of at least 4 to further improve polishing performance for some polishing applications. For example, unit cells with an extended horizontal length will tend to provide stiffer polishing elements for improved planarization; and unit cells with extended vertical length will tend to have more flexible polishing members for improved defectivity performance.

An advantage of the high mean height to mean width ratio of elements 208 is that the total polishing surface area of cross-sectional area 222 remains constant for an extended period. As shown in FIG. 2, at any point in the life of polishing layer 202, while most of the contacting area of polishing texture 200 consists of the cross-sections 222 of upright elements 208, all or part of some interconnecting elements 204 will also be in the process of wearing down, and these are designated in particular as contact elements 206. Preferably, the vertical positions of interconnecting elements 204 are staggered such that wear occurring parallel to the base layer 240 encounters only a small fraction of interconnecting elements 204 at a given point in time, and these contact elements 206 constitute a small fraction of the total contacting area. This allows polishing of several substrates with similar polishing characteristics and reduces or eliminates the need to periodically dress or condition the pad. This reduction in conditioning extends the pad's life and lowers its operating cost. Furthermore, perforations through the pad, the introduction of conductive-lined grooves or the incorporation of a conductor, such as conductive fibers, conductive network, metal grid or metal wire, can transform the pads into eCMP ("electrochemical mechanical planarization") polishing pads. These pads' three-dimensional network structure may facilitate polishing medium flow in the hydrodynamic region 203 and maintain a consistent surface structure for demanding eCMP applications. It is believed that an increase in polishing medium flow in the hydrodynamic region 203 may improve the removal of spent electrolyte from the eCMP process that may improve uniformity of the eCMP process.

Preferably, substantially no co-continuous fugitive phase material 205 exists within the hydrodynamic region 203 of polishing texture 200. That is, the only solid material in the hydrodynamic region 203 is the continuous non-fugitive phase material 207 of which polishing elements 204 and 208 are comprised. Optionally, it is possible to secure abrasive particles or fibers to polishing elements 204 and 208. Correspondingly, no void volume exists within any individual element 204 or 208; all void volume in polishing texture 200 preferably exists between and distinctly outside polishing elements 204 and 208. Optionally, however, polishing elements 204 and 208 may have a hollow or porous structure. Polishing elements 208 are rigidly affixed at one end to a base layer 240 that maintains the pitch 218 and maintains polishing elements 208 in a substantially upright orientation. The orientation of elements 208 is further maintained by interconnecting elements 204 at junctions 209 that connect adjacent polishing elements 204 and 208. The junctions 209 may include an adhesive or chemical bond to secure elements 204 and 209. Preferably, junctions 209 represent an interconnection of the same materials and most preferably a seamless interconnection of the same materials.

It is preferred that width 210 and pitch 218 of the polishing elements 208 be uniform, or nearly so, across all polishing elements 208 from end to end between junctions 209, or uniform across subgroups of polishing elements 208. For example, preferably polishing elements 208 have a width 210 and pitch 218 that remain within 50% of the average width or pitch, respectively, in the polishing layer 202 between contact member 206 and half height 215. More preferably, polishing elements 208 have a width 210 and pitch 218 that remain within 20% of the average width or pitch, respectively, in the polishing layer 202 between contact member 206 and half height 215. Most preferably, polishing elements 208 have a width 210 and pitch 218 that remain within 10% of the average width or pitch, respectively, in the polishing layer 202 between contact member 206 and half height 215. In particular, maintaining cross-sectional area of polishing elements 204 and 208 between adjacent junctions 209 to within 30% facilitates consistent polishing performance. Preferably, the pad maintains cross sectional area to within 20% and most preferably to within 10% between adjacent junctions 209. Furthermore, polishing elements 204 and 208 preferably have a linear shape to further facilitate consistent polishing. A direct consequence of these features is that the cross-sectional area 222 of the polishing elements 208 does not vary considerably in the vertical direction. Thus as polishing elements 208 are worn during polishing and the height 214 decreases, there is little change in the area 222 presented to the wafer. This consistency in surface area 222 provides for a uniform polishing texture 200 and allows consistent polishing for repeated polishing operations. For example, the uniform structure allows polishing of multiple patterned wafers without adjusting the tool settings. For purposes of this specification, the polishing surface or texture 200 represents the surface area of polishing elements 204 and 208 measured in a plane parallel to the polishing surface. Preferably the total cross sectional area 222 of polishing elements 208 remains within 25 percent between the initial polishing surface or contact elements 206 and the half-height 215 of the vertical column of unit cells 225. Most preferably, the total cross sectional area 222 of polishing elements 208 remains within 10 percent between the initial polishing surface and the half-height 215 of the vertical column of unit cells 225. As noted previously, it is further preferable that the vertical positions of interconnecting elements 204 are staggered to minimize the change in total cross sectional area as the elements wear down.

Optionally, it is possible to arrange polishing elements 208 in spaced groupings of several polishing elements 208—for example, the polishing elements may comprise circular groupings surrounded by areas free from polishing elements. Within each grouping, it is preferred that interconnecting elements 204 be present to maintain the spacing and effective stiffness of the groupings of elements 208. In addition, it is possible to adjust the density of the polishing elements 204 or 208 in different regions to fine tune removal rates and polishing or wafer uniformity. Furthermore, it is possible to arrange the polishing elements in a manner that forms open channels in the hydrodynamic region 203, such as circular channels, X-Y channels, radial channels, curved-radial channels or spiral channels. The introduction of these optional channels may facilitate removal of large debris and may improve polishing or wafer uniformity.

It is preferable that height 214 of polishing elements 208 be uniform across all elements. It is preferred that height 214 remains within 20% of the average height, more preferably, remains within 10% of the average height, and even more preferably, remains within 1% of the average height within polishing texture 200. Optionally, a cutting device, such as a knife, high-speed rotary blade or laser may periodically cut the polishing elements to a uniform height. Furthermore, the diameter and speed of the cutting blade can optionally cut the polishing elements at an angle to alter the polishing surface. For example cutting polishing elements having a circular cross section at an angle will produce a texture of polishing tips that interact with the substrate. Uniformity of height ensures that all polishing elements 208 of polishing texture 200, as well as all interconnecting contact elements 206 in the plane of wear, have the potential to contact the workpiece. In fact, because industrial CMP tools have machinery to apply unequal polish pressure at different locations on the wafer, and because the fluid pressure generated under the wafer is sufficient to cause the wafer to depart from a position that is precisely horizontal and parallel to the mean level of the pad, it is possible that some polishing elements 208 do not contact the wafer. However in any regions of polishing pad 104 where contact does occur, it is desired that as many polishing elements 208 as possible be of sufficient height to provide contact. Furthermore, since the unbuttressed ends of polishing elements 208 will typically bend with the dynamic contact mechanics of polishing, an initial polish surface area will typically wear to conform to the bend angle. For example, an initial circular top surface will wear to form an angled top surface and the changes in direction experienced during polishing will create multiple wear patterns.

The dimensions and spacing of polishing elements 204 and 208 are chosen to provide both high contact area 222 between the pad and wafer and adequate open area 226 to enable slurry in the hydrodynamic region 203 to remove polish debris. Typically, the continuous non-fugitive phase 207 (i.e., the polishing elements 204 and 208) constitutes less than 80 percent of the polishing pad volume measured above the base layer 240. Preferably the polishing elements 204 and 208 constitute less than 75 percent of the polishing pad volume measured above the base layer 240. For example, typically elements 204 and 208 will occupy 5 to 75 percent of the polishing pad volume measured above the base layer 240. Polishing pads designed for high contact area typically occupy 40 to 80 percent of the polishing pad volume measured above the base layer 240. There is an intrinsic trade-off between these objectives: adding more polishing elements 204 and 208 in the available space of polishing texture 200 augments the total contact area 222 but reduces the open area 226 creating more obstacles to slurry flow 230 in the hydrodynamic region 203 and the removal of polish debris. An essential feature of the present invention is that polishing elements 204 and 208 be sufficiently slender and widely spaced to allow a favorable balancing of contact area and open area in the hydrodynamic region 203. Polishing elements 208 with rectangular or square cross-sections are advantageous for increasing contact area. Pursuant to this balance, the ratio of the pitch 218 of polishing elements 208 to the width 210 of polishing elements 208 may optionally be at least 2. With these limits, elements 204 and 208 may occupy up to 50 percent of the polishing pad volume measured above the base layer 240, the contact area 222 of polishing texture 200 may reach 25% (that is, the square of one minus the width/pitch ratio) or greater and the open area 226 is 50% of the available area (that is, one minus the width/pitch ratio) or greater. It is further possible that the ratio of the height 214 to the width 210 of the polishing elements 208 may optionally be at least 4, to maximize the open area 226 in the hydrodynamic region 203 (i.e., area that is not occupied by co-continuous fugitive phase 205 or continuous non-fugitive phase 207) and to allow polish debris to be conveyed horizontally among the polishing elements 204 and 208 while still providing vertical distance between this conveyed debris and the wafer.

Polishing texture 200 is further optimized by choosing the cross-sectional shape of polishing elements 204 and 208 to be streamlined with respect to slurry flow 230 that occurs predominantly in a horizontal direction relative to the polishing surface in the hydrodynamic region 203. Streamlining of bodies to achieve minimum fluid drag is a well-established discipline of engineering and forms part of the science routinely applied in the design of aircraft, watercraft, automobiles, projectiles, and other objects that move in or relative to a gas or liquid. The equations of fluid flow governing these latter human-scale objects apply identically at the scale of CMP pad macrostructure or microstructure. In essence streamlining consists in choosing a gradually curved cross-section free of sharp transitions such that an external fluid flow may pass around the cross-section without separating from the surface and forming recirculating eddies that consume fluid energy. Pursuant to this consideration, a circular cross-section 222 is preferred over a square or rectangular cross-section for polishing elements 204 and 208. Further streamlining of the shapes of polishing elements 208 requires knowledge of the local direction of the slurry flow 230 in the hydrodynamic region 203. Because both the pad and wafer are rotating, the slurry flow 230 in the hydrodynamic region 203 may approach the polishing elements 204 and 208 from a variety of angles and the correct streamlining for one angle of approach will be sub-optimal for other angles of approach. The only shape that is streamlined equally to all directions of fluid approach is a circular cross-section, thus it is preferred in the general case. If the dominant flow direction can be determined, as in the case of a CMP process having a very high ratio of platen speed to carrier speed, it is more preferred to streamline the cross-section of polishing elements 204 and 208 with respect to that direction.

As shown in FIG. 2, polishing pad 104 includes polishing layer 202 and may include in addition a subpad 250. It is noted that subpad 250 is not required and polishing layer 202 may be secured directly, via base layer 240, to a platen of a polisher, e.g., platen 130 of FIG. 1. Polishing layer 202 may be secured, via base layer 240, to subpad 250 in any suitable manner, such as adhesive bonding, e.g., using a pressure sensitive adhesive layer 245 or hot-melt adhesive, heat bonding, chemical bonding, ultrasonic bonding, etc. The base layer 240 or subpad 250 may serve as the polishing base for attachment of the polishing elements 208. Preferably, a base portion of polishing elements 208 extends into base layer 240.

Various methods of manufacture are possible for polishing texture 200. For larger-scale networks, these include micromachining, laser or fluid-jet etching, and other methods of material removal from a starting solid mass; and focused laser polymerization, filament extrusion, fiber spinning, preferential optical curing, biological growth, and other methods of material construction within an initially empty volume. For smaller-scale networks, crystallization, seed polymerization, lithography or other techniques of preferential material deposition may be employed, as well as electrophoresis, phase nucleation, or other methods of establishing a template for subsequent material self-assembly.

The continuous non-fugitive phase 207 (i.e., polishing elements 204 and 208) and base layer 240 of microstructure 200 may be made of any suitable material, such as polycarbonates, polysulfones, nylons, polyethers, polyesters, polystyrenes, acrylic polymers, polymethyl methacrylates, polyvinylchlorides, polyvinylfluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and mixtures thereof. Polishing elements 204 and 208 and base layer 240 may also be made of a non-polymeric material such as ceramic, glass, metal, stone, wood, or a solid phase of a simple material such as ice. Polishing elements 204 and 208 and base layer 240 may also be made of a composite of a polymer with one or more non-polymeric materials.

In general, the choice of material for the continuous non-fugitive phase 207, the co-continuous fugitive phase 205 and base layer 240 is limited by its suitability for polishing an article made of a particular material in a desired manner. Similarly, subpad 250 may be made of any suitable material, such as the materials mentioned above for the continuous non-fugitive phase 207 and base layer 240. Polishing pad 104 may optionally include a fastener for securing the pad to a platen, e.g., platen 130 of FIG. 1, of a polisher. The fastener may be, e.g., an adhesive layer, such as a pressure sensitive adhesive layer 245, hot melt adhesive, a mechanical fastener, such as the hook or loop portion of a hook and loop fastener. It is also within the scope of the invention to implement one or more fiber-optic endpointing devices 270 or similar transmission devices that occupy one or more of the void spaces of polishing texture 200.

Figure 4:
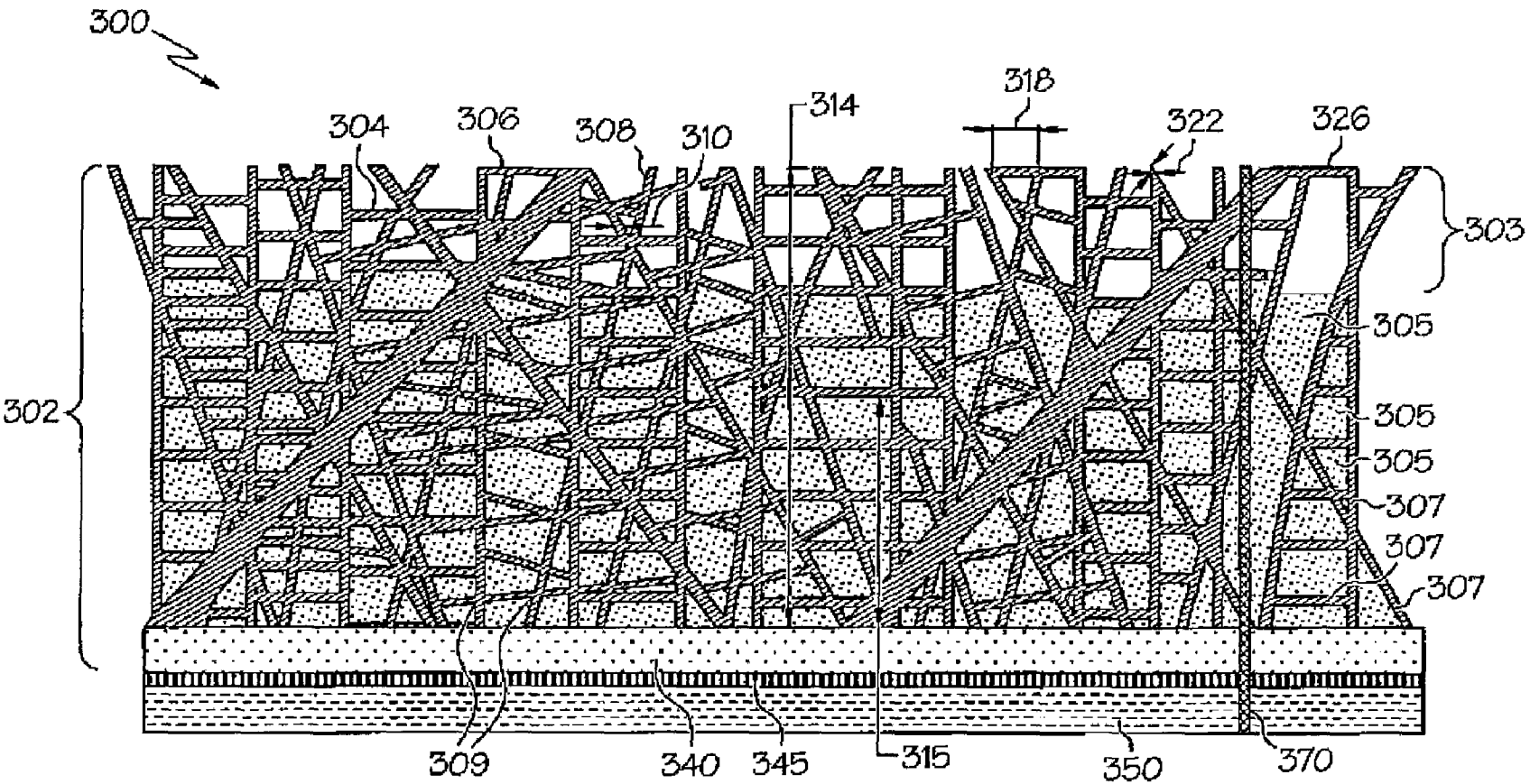
FIG. 4 is a highly enlarged, partial, schematic, cross-sectional, elevational view of a chemical mechanical polishing pad of one embodiment of the present invention.

The polishing texture 300 of FIG. 4 illustrates that the present invention comprehends a continuous non-fugitive phase forming open interconnected networks comprising elements positioned at all angles from fully horizontal to fully vertical. By extension, the invention comprehends a continuous non-fugitive phase forming an entirely random array of slender elements in which there is no clearly repeating size or shape to the void spaces within the polishing texture that are not occupied by the continuous non-fugitive phase, or where many elements are highly curved, branched, or entangled. Familiar images that, as continuous non-fugitive phase microstructures, would fall within the scope of the invention are bridge trusses, stick models of macromolecules, and interconnected human nerve cells. In each case the structure must possess the same critical features, namely that sufficient interconnection in three dimensions is present to stiffen the overall network, that a wearing of the network in a horizontal plane from the top surface produces slender elements having locally unbuttressed ends that provide compliance with a workpiece over short length scales, and that the space not occupied by the continuous non-fugitive phase and length to width ratio of the elements conform to the geometric limits given previously. Further, FIG. 4 illustrates that the present invention comprehends a co-continuous fugitive phase that substantially fills the areas of the polishing texture 300 not occupied by the continuous non-fugitive phase and not within the hydrodynamic region.

With reference to FIG. 4, a second embodiment of polishing pad 104 of FIG. 1 consistent with the present invention is described with respect to an alternative surface polishing texture 300—a side cross-sectional view of FIG. 4 would have a similar asymmetrical pattern of interconnected reticulated unit cells within polishing layer 302. Similar to the pad of FIG. 2, adhesive layer 345 secures base layer 340 to optional subpad 350; and optionally includes endpointing device 370. Polishing texture 300 comprises a continuous non-fugitive phase 307 and a co-continuous fugitive phase 305. The continuous non-fugitive phase 307 comprises elements 304 and 308. Polishing texture 300 differs from polishing texture 200 of FIG. 2 in three aspects. First, the elements 308 of polishing texture 300 are not strictly vertical but are positioned at a variety of angles between 45 and 90 degrees with respect to the base layer 340 and the horizontal plane, and a few of the elements 308 are curved rather than straight. Also, the interconnecting elements 304 are not all horizontal but some are positioned at angles of 0 to 45 degrees with respect to the base layer 340 and the horizontal plane. As such, polishing texture 300 consists of unit cells, but the cells vary in shape and number of faces. These features notwithstanding, height 314 of elements 308 does not vary substantially within polishing texture 300 between the polishing layer or polishing element 306 and the half height 315 of the polishing texture 300. Second, there is more variation in the width 310, pitch 318, and cross-sectional area 322 among elements 304 and 308 than in the corresponding attributes of polishing elements 208. Third, the slurry flow through and among elements 304 and 308 in the hydrodynamic region 303 follows more irregular paths than the slurry flow through polishing elements 208 in the hydrodynamic region 203. Nonetheless, polishing texture 300 embodies the essential properties of the present invention where elements 306 form the polishing surface. In particular, the elements 304 and 308 interconnect at junctions 309 to form a network interconnected in three dimensions to a sufficient degree to impart stiffness to the polishing texture as a whole, while the unbuttressed ends of elements 308 provide local flexibility to conform to a workpiece. In addition, the elements 304 and 308 are still sufficiently slender and widely spaced to allow a favorable balancing of contact area and flow area; the ratio of the mean pitch 318 of elements 308 to the mean width 310 of elements 308 is at least 2 and the ratio of the height 314 to the mean width 310 of the elements 308 is at least 4. As such, the contact area 322 of polishing texture 300 may reach 25% or greater and the open area 326, while more irregular than flow area 226 of polishing texture 200, is large enough to allow polish debris to be conveyed horizontally among the elements 304 and 308 in the hydrodynamic region 303 not occupied by co-continuous fugitive phase 305, while still providing vertical distance between this conveyed debris and the wafer.

Figure 5:
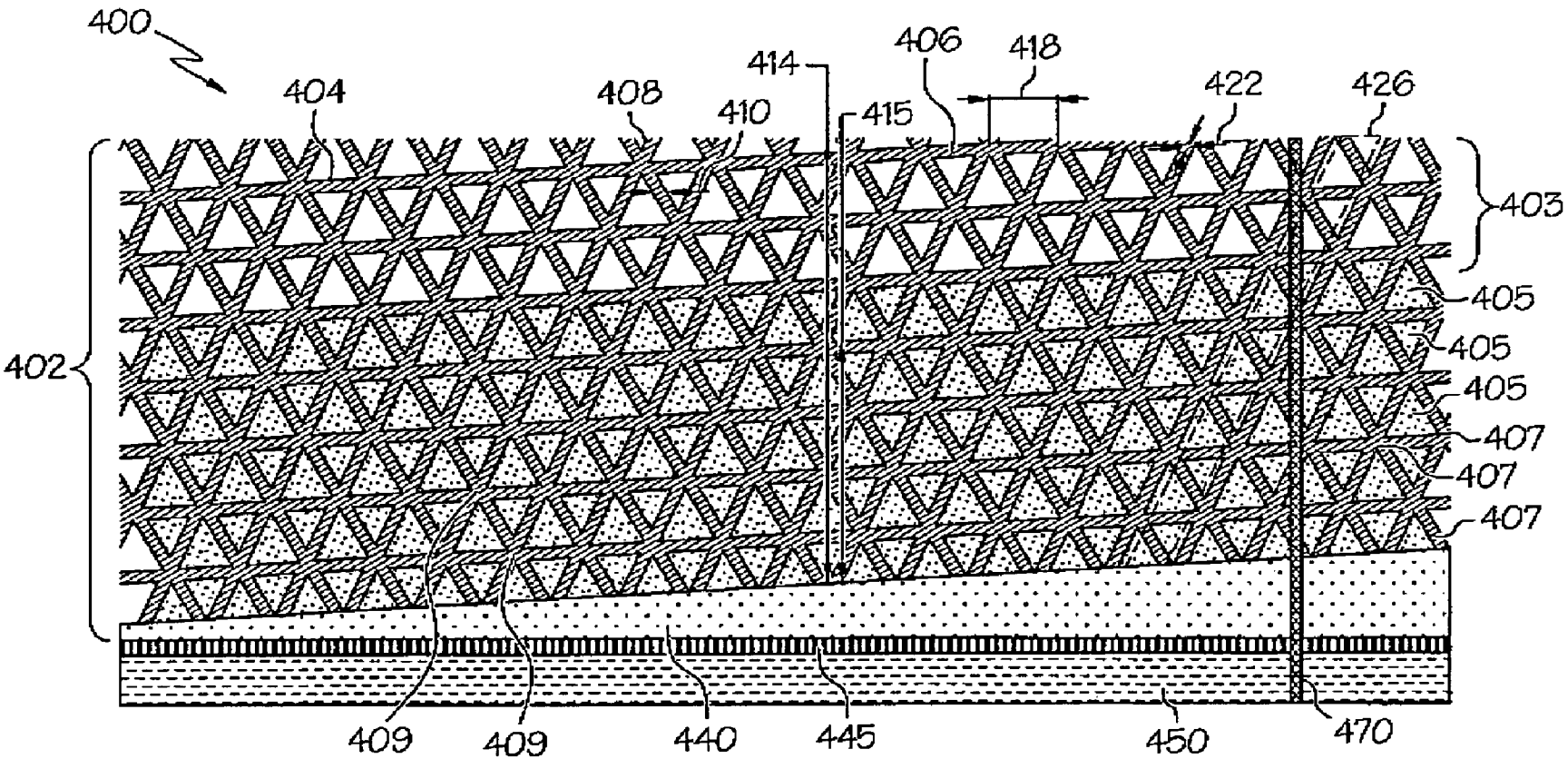
FIG. 5 is a highly enlarged, partial, schematic, cross-sectional, elevational, view of a chemical mechanical polishing pad of one embodiment of the present invention.

An additional embodiment of the invention is shown in FIG. 5 and consists of polishing layer 402 having a continuous non-fugitive phase 407 comprising a regular-spaced interconnected tetrahedral lattice of elements 404 and 408.

All elements 404 and 408 are shown as identical in length and width that join at junctions 409, though this need not be so. In the embodiment shown, the unit cell is a regular tetrahedron in which each (of four) faces is an equilateral triangle, the side of which is the pitch 418 of the network, and solid members having a width 410 run along only the four edges of the spatial unit, leaving the center of each triangular face and of the spatial unit as a whole empty. Because of the symmetry of the tetrahedral lattice, a side cross-sectional and plan view of FIG. 5 would form the same reticulated pattern. This polishing texture provides the highest possible stiffness because triangularly faceted polyhedra are non-deformable. As the structure wears, free ends are formed on elements 408 that provide local deformability and compliance to the workpiece. In the embodiment shown in FIG. 5, the tetrahedral network is constructed on a slightly wedge-shaped base layer 440 so that no planes of the network are positioned exactly parallel to the plane of contact with the wafer. At a given point in time only a subset of members 406 are wearing along their longest dimension, while most of the area of contact is provided by the smaller cross sectional areas 422 of elements wearing across their shorter dimensions. This provides the feature that the contact area remains essentially invariant over the height 414 between the polishing layer or polishing element 406 and the half height 415 of the polishing texture 400. Across the wedge-shaped base layer 440, the mean area 426 for slurry flow in the hydrodynamic region 403 not occupied by co-continuous fugitive phase 405 may vary slightly. Although not depicted in the drawing, in some embodiments of the present invention, the co-continuous fugitive phase material could have a top surface that coincides with the polishing interface (e.g., when the co-continuous phase material melts upon exposure to heat present during polishing). To minimize this variation, in practice base layer 440 is stepped such that a repeating series of wedge-shaped sections supports the network. The structure shown in FIG. 5 is approximately one repeating unit. Similar to the pad of FIG. 2, adhesive layer 445 secures base layer 440 to optional subpad 450; and optionally includes endpointing device 470.

The invention provides the advantage of decoupling contact mechanics from fluid mechanics. In particular, it allows effective slurry flow within the hydrodynamic region of the polishing pad to easily remove polishing debris. In addition, it allows adjustment of the polishing elements' stiffness, height and pitch to control contact mechanics with a substrate. Furthermore, the polishing elements' shape allows the reduction or elimination of conditioning for increased polishing pad life. Finally, the uniform cross sectional area allows polishing of multiple substrates, such as patterned wafers with similar polishing characteristics.

In some embodiments of the present invention, the chemical mechanical polishing pad has a central axis and is adapted for rotation about the central axis. (See FIG. 6). In some aspects of these embodiments, the polishing layer 510 of the chemical mechanical polishing pad is in a plane substantially perpendicular to the central axis 512. In some aspects of these embodiments, the polishing layer 510 is adapted for rotation in a plane that is at an angle, θ, of 80 to 100° to the central axis 512. In some aspects of these embodiments, the polishing layer 510 is adapted for rotation in a plane that is at an angle, θ, of 85 to 95° to the central axis 512. In some aspects of these embodiments, the polishing layer 510 is adapted for rotation in a plane that is at an angle, θ, of 89 to 91° to the central axis 512. In some aspects of these embodiments, the polishing layer 510 has a polishing surface 514 that has a substantially circular cross section perpendicular to the central axis 512. In some aspects of these embodiments, the radius, r, of the cross section of the polishing surface 514 perpendicular to the central axis 512 varies by ≦20% for the cross section. In some aspects of these embodiments, the radius, r, of the cross section of the polishing surface 514 perpendicular to the central axis 512 varies by ≦10% for the cross section.

Figure 6:
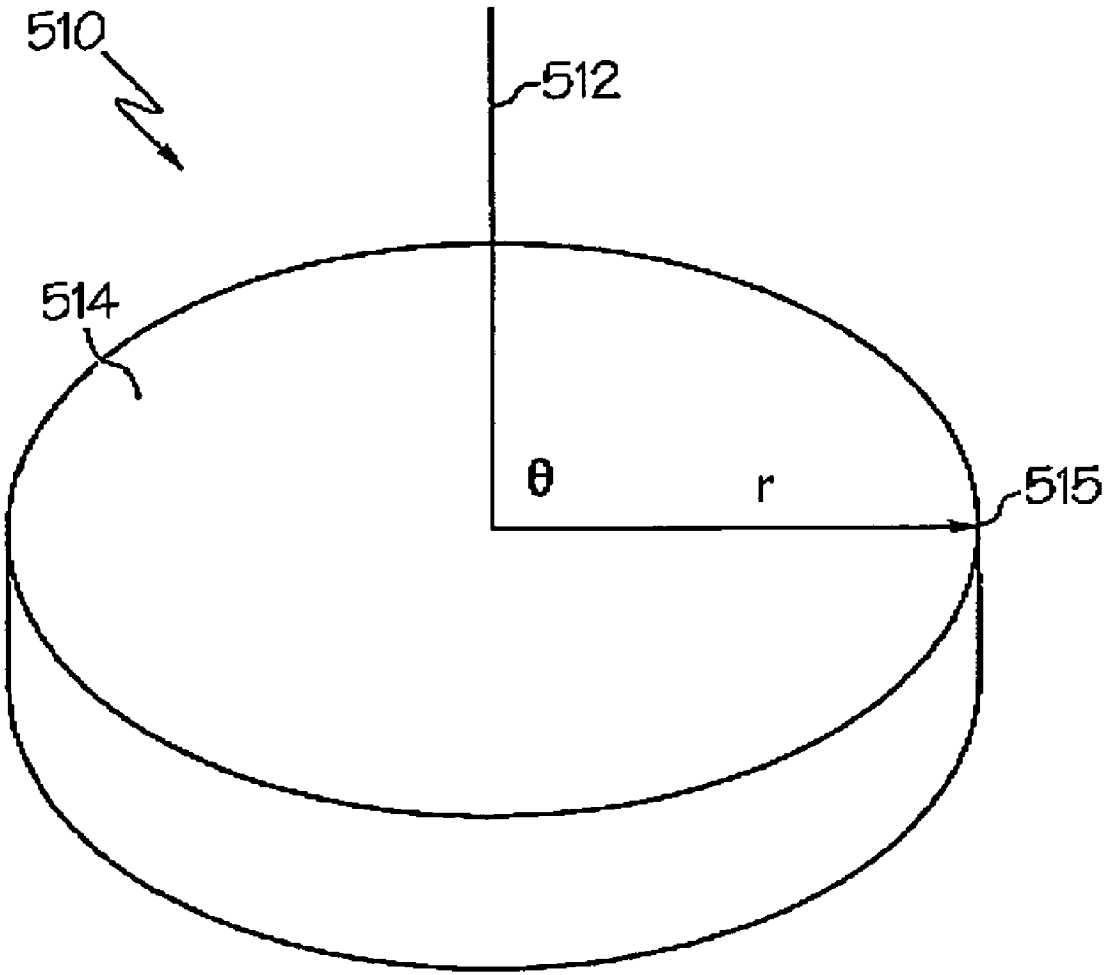
FIG. 6 is a side perspective view of a chemical mechanical polishing pad of one embodiment of the present invention.

In FIG. 6 there is provided a side perspective view of a chemical mechanical polishing pad of one embodiment of the present invention. In particular, FIG. 6 depicts a single layer chemical mechanical polishing pad 510. The chemical mechanical polishing pad 510 has a polishing surface 514 and a central axis 512. The polishing surface 514 has a substantially circular cross section with a radius r from the central axis 512 to the outer periphery of the polishing surface 515 in a plane at an angle θ to the central axis 512.

Figure 7:
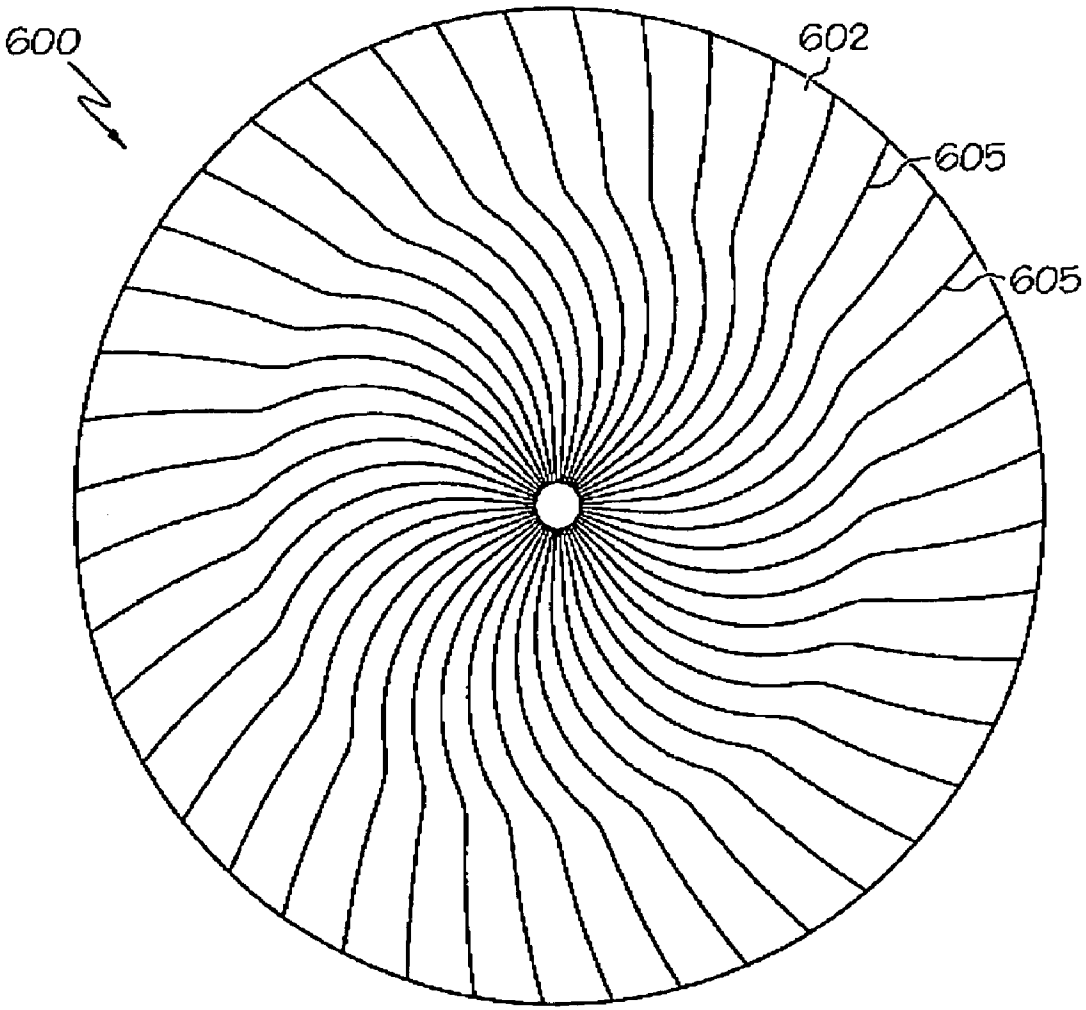
FIG. 7 is a top plan view of a chemical mechanical polishing pad of one embodiment of the present invention depicting a groove pattern in the polishing surface.

In FIG. 7 there is provided a top plan view of a chemical mechanical polishing pad of one embodiment of the present invention. In particular, FIG. 7 depicts a chemical mechanical polishing pad 600 having a polishing surface 602 with a groove pattern of a plurality of curved grooves 605.

Figure 8:
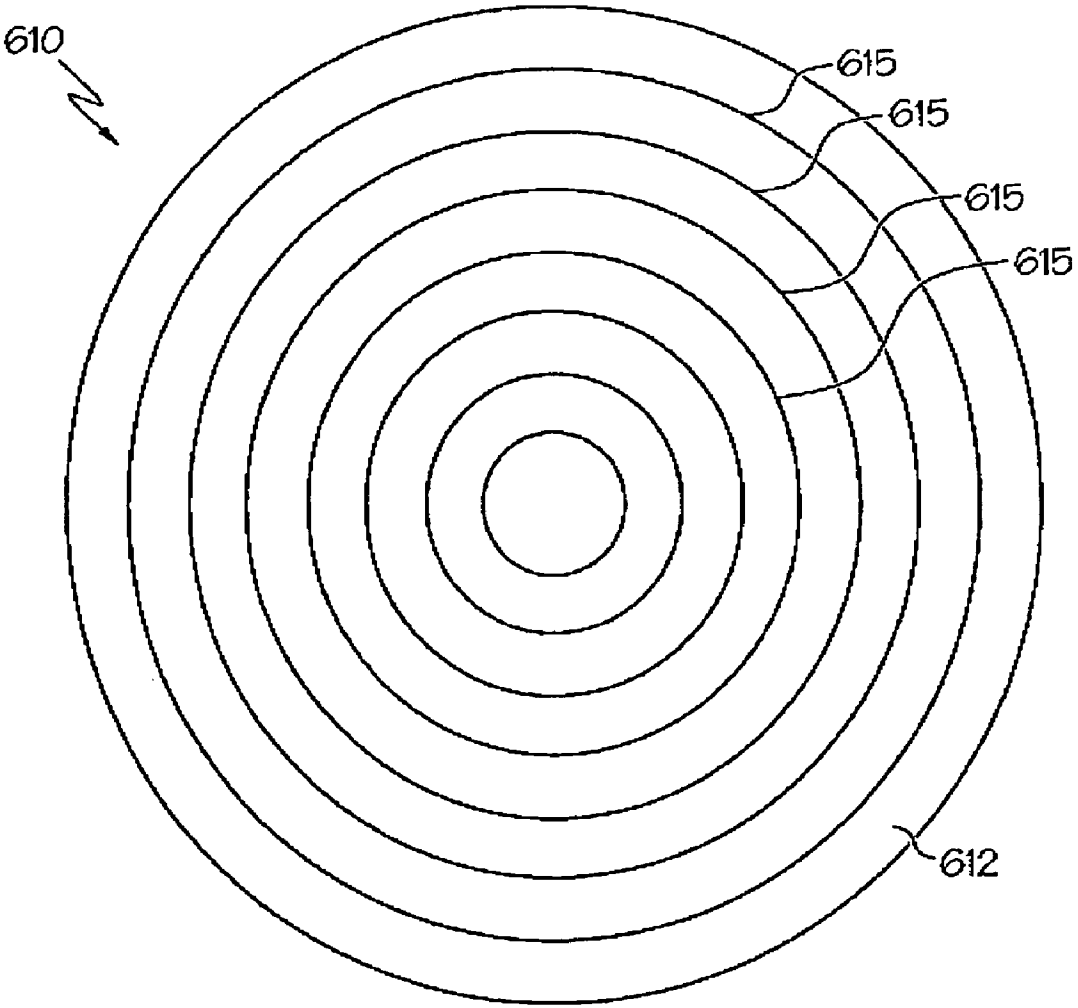
FIG. 8 is a top plan view of a chemical mechanical polishing pad of one embodiment of the present invention depicting a groove pattern in the polishing surface.

In FIG. 8 there is provided a top plan view of a chemical mechanical polishing pad of one embodiment of the present invention. In particular, FIG. 8 depicts a chemical mechanical polishing pad 610 having a polishing surface 612 with a groove pattern of a plurality of concentric circular grooves 615.

Figure 9:
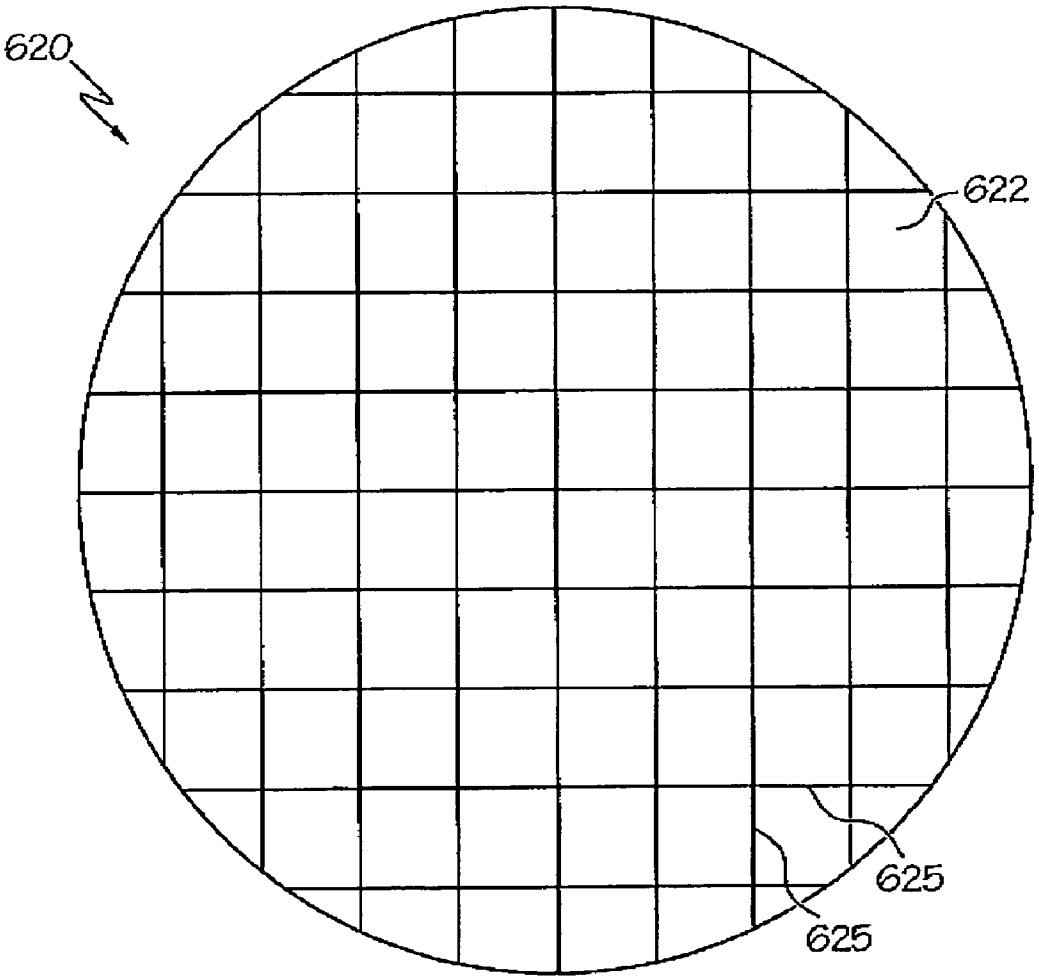
FIG. 9 is a top plan view of a chemical mechanical polishing pad of one embodiment of the present invention depicting a groove pattern in the polishing surface.

In FIG. 9 there is provided a top plan view of a chemical mechanical polishing pad of one embodiment of the present invention. In particular, FIG. 9 depicts a chemical mechanical polishing pad 620 having a polishing surface 622 with a groove pattern of a plurality of linear grooves 625 in an X-Y grid pattern.

Figure 10:
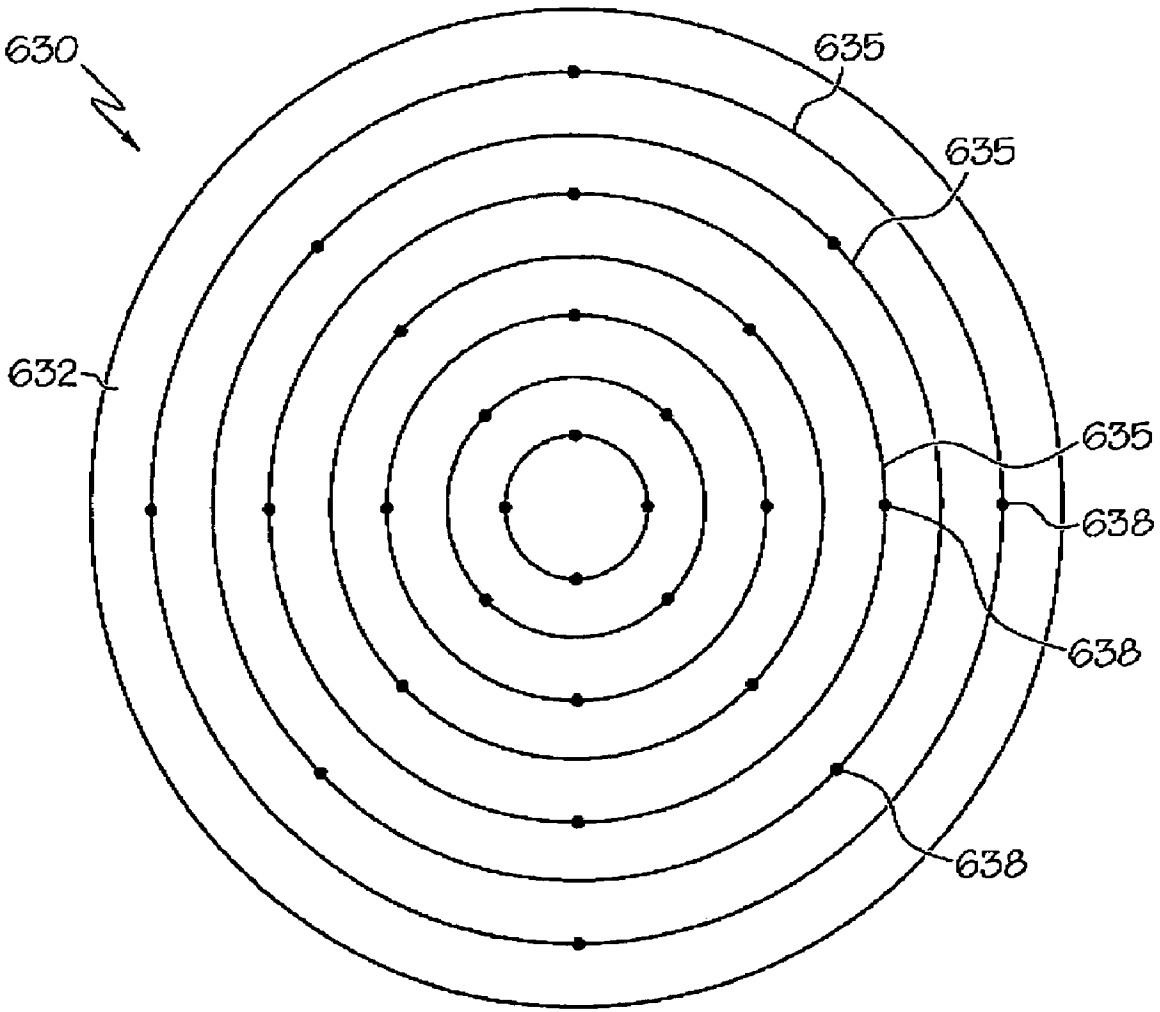
FIG. 10 is a top plan view of a chemical mechanical polishing pad of one embodiment of the present invention depicting a combination of perforations and groove pattern in the polishing surface.

In FIG. 10 there is provided a top plan view of a chemical mechanical polishing pad of one embodiment of the present invention. In particular, FIG. 10 depicts a chemical mechanical polishing pad 630 having a polishing surface 632 with a combination of a plurality of perforations 638 and a plurality of concentric circular grooves 635.

Figure 11:
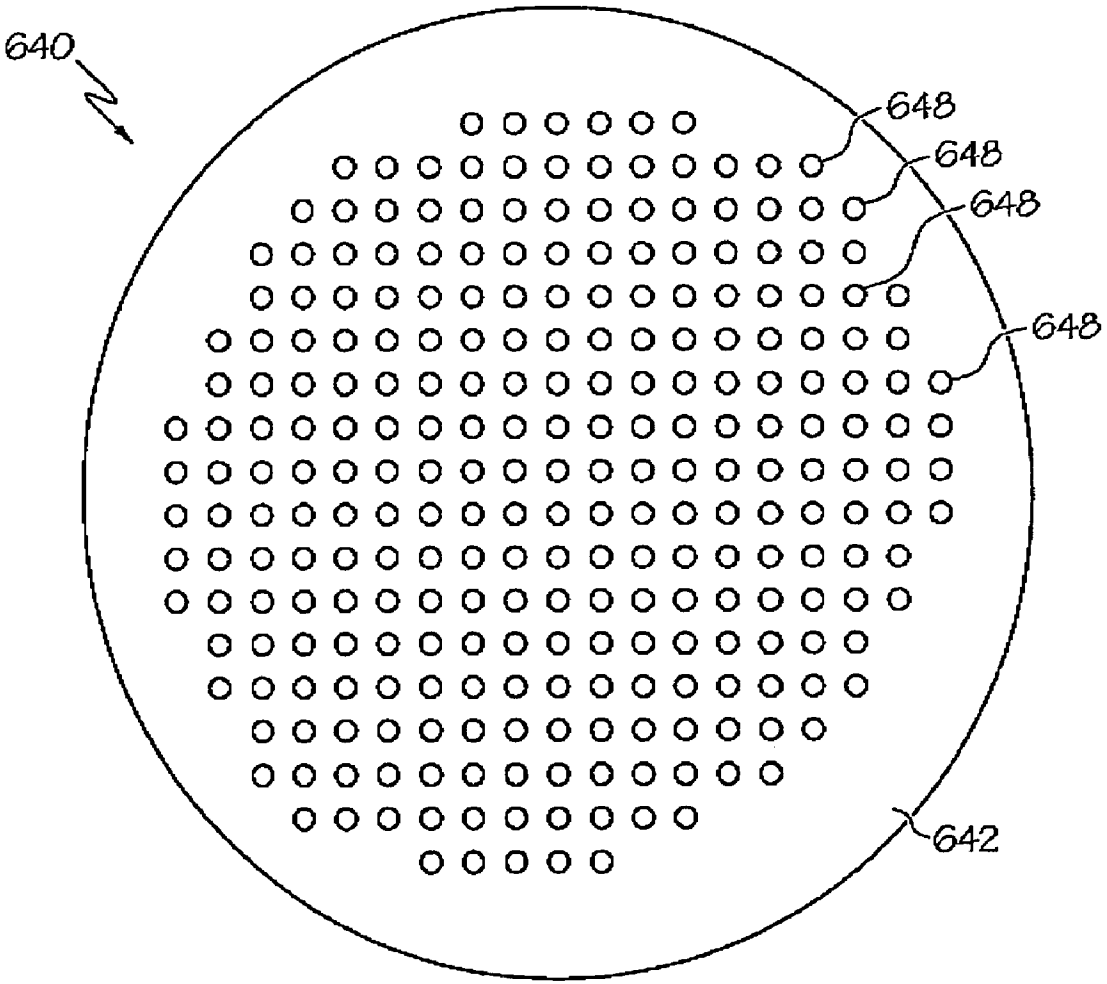
FIG. 11 is a top plan view of a chemical mechanical polishing pad of one embodiment of the present invention depicting a plurality of perforations in the polishing surface.

In FIG. 11 there is provided a top plan view of a chemical mechanical polishing pad of one embodiment of the present invention. In particular, FIG. 11 depicts a chemical mechanical polishing pad 640 having a polishing surface 642 with a plurality of perforations 648.

I claim:

1. A chemical mechanical polishing pad for polishing a substrate selected from at least one of a magnetic substrate, an optical substrate and a semiconductor substrate; comprising:

a polishing layer comprising an interpenetrating network, wherein the interpenetrating network comprises a continuous non-fugitive phase and a substantially co-continuous fugitive phase; wherein the continuous non-fugitive phase is not covalently bound to the co-continuous fugitive phase; wherein the co-continuous fugitive phase melts upon exposure to heat generated during polishing; and wherein the polishing layer has a polishing surface adapted for polishing the substrate.

2. The chemical mechanical polishing pad of claim 1, wherein the chemical mechanical polishing pad comprises a hydrodynamic region proximate to the polishing surface, wherein the hydrodynamic region is substantially free of the fugitive phase.

3. The chemical mechanical polishing pad of claim 2, wherein the hydrodynamic region extends from the polishing surface into the chemical mechanical polishing pad to a depth of 1 to 100 microns.

4. The chemical mechanical polishing pad of claim 1, wherein the continuous non-fugitive phase forms a reticulated network.

5. The chemical mechanical polishing pad of claim 1, wherein the continuous non-fugitive phase has a fibrillar morphology.

6. The chemical mechanical polishing pad of claim 1, wherein the polishing layer comprises 0.5 to 80 vol % of the continuous non-fugitive phase.

7. A method for polishing a substrate, comprising:

providing a substrate selected from at least one of a magnetic substrate, an optical substrate and a semiconductor substrate;

providing a chemical mechanical polishing pad having a polishing layer comprising an interpenetrating network, wherein the interpenetrating network comprises a continuous non-fugitive phase and a substantially co-continuous fugitive phase, wherein the continuous non-fugitive phase is not covalently bound to the co-continuous fugitive phase, wherein the co-continuous fugitive phase melts upon exposure to heat generated during polishing, wherein the polishing layer has a polishing surface adapted for polishing the substrate;

providing a polishing medium at an interface between the polishing surface and the substrate; and, creating dynamic contact at the interface between the chemical mechanical polishing pad and the substrate.

* * * * *